US006942557B2

(12) United States Patent
Sun

(10) Patent No.: US 6,942,557 B2
(45) Date of Patent: Sep. 13, 2005

(54) HANDHELD POWER TOOL

(75) Inventor: Xuefeng Sun, Suzhou (CN)

(73) Assignee: Positec Power Tools (Suzhou) Co., Suzhou (CN)

( * ) Notice: Subject to any disclaimer, the term of this patent is extended or adjusted under 35 U.S.C. 154(b) by 0 days.

(21) Appl. No.: 10/760,128

(22) Filed: Jan. 16, 2004

(65) Prior Publication Data

US 2004/0166787 A1 Aug. 26, 2004

(30) Foreign Application Priority Data

Jan. 24, 2003 (CN) ..... 03219560

(51) Int. Cl.[7] ..... B24B 23/00

(52) U.S. Cl. ..... 451/344; 15/28; 15/97.1; 16/430

(58) Field of Search ..... 451/344, 353, 451/354, 359; 15/DIG. 10, 143.1, 97.1, 28; 16/110.1, 430; D8/62

(56) References Cited

U.S. PATENT DOCUMENTS 5,309,594 A * 5/1994 Thompson ..... 15/97.1
D379,749 S 6/1997 Gildersleeve et al.
6,168,507 B1 1/2001 McCracken
6,266,850 B1 * 7/2001 Williams et al. ..... 16/430
D465,074 S * 10/2002 McCracken et al. ..... D32/15
6,499,172 B1 * 12/2002 McCracken ..... 15/97.1
D471,681 S * 3/2003 Krieger et al. ..... D32/15

* cited by examiner

*Primary Examiner*—David B. Thomas
(74) *Attorney, Agent, or Firm*—Knobbe, Martens, Olson & Bear, LLP

(57) ABSTRACT

The present invention relates to a handheld power tool including: a main housing, a rear handle mounted on the main housing and a handle connected to the main housing. A base portion of the main housing has a buffing member in the basal plane. The handle comprises two oppositely disposed side handle members and a front handle joined between the front end portions of the two oppositely disposed side handle members. The two oppositely disposed side handle members tilt (ie are non-parallel) with respect to the basal plane. The present invention has the advantage that during buffing of a workpiece, the operator's wrists need bend to only a small degree to accommodate the non-parallel disposition of the buffing member leading to labour efficiency and reduced wrist tiredness.

10 Claims, 4 Drawing Sheets

HANDHELD POWER TOOL

CLAIM OF PRIORITY

This application claims priority under 35 U.S.C. §119 to Chinese Patent Application No. 03219560.5 filed Jan. 24, 2003, which is hereby incorporated herein by reference in its entirety.

BACKGROUND OF THE INVENTION

1. Field of the Invention

The present invention relates to a handheld power tool such as a buffer or a polisher.

2. Description of the Related Art

Conventional handheld power tools for buffing or polishing comprise a main housing, a rear handle mounted on the main housing and a handle connected to the main housing. The handle adopts a substantially circular configuration. A base portion of the main housing has a buffing member in the basal plane. The handle and the basal plane of the buffing member are parallel. During the buffing of a workpiece, the operator's wrists bend to a large degree to accommodate the parallel disposition of the buffing member and the handle. This rapidly causes the operator's wrists to tire and the buffing effect to be inefficient. FIGS. 4 and 6 are intended to illustrate the bend which must be deployed in the operators wrists to operate the buffing member at the base of the main housing 2.

SUMMARY OF THE INVENTION

It is an object of the present invention to provide an easily operated handheld power tool such as a buffer or a polisher.

Thus viewed from one aspect the present invention provides a handheld power tool including:

a main housing having a base portion, wherein the base portion has a buffing member in the basal plane, a rear handle mounted on the main housing, a handle connected to the main housing, wherein the handle comprises:

two oppositely disposed side handle members each having a front end portion and a rear end portion and a front handle member connected between the front end portions of the two oppositely disposed side handle members, wherein the front handle member has side end portions, wherein the two oppositely disposed side handle members are tilted with respect to the basal plane.

The present invention relates to a handheld power tool including: a main housing, a rear handle mounted on the main housing and a handle connected to the main housing. A base portion of the main housing has a buffing member in the basal plane. The handle comprises two oppositely disposed side handle members and a front handle joined between the front end portions of the two oppositely disposed side handle members. The two oppositely disposed side handle members tilt (ie are non-parallel) with respect to the basal plane.

The present invention has the advantage that during buffing of a workpiece, the operator's wrists need bend to only a small degree to accommodate the non-parallel disposition of the buffing member and the handle. The pressure applied to the operator's arm is substantially in the same direction as that applied by the main housing to the workpiece leading to labour efficiency and reduced wrist tiredness.

Preferably the two oppositely disposed side handle members each have at least one upwardly arched arcuate portion.

Preferably the front handle member has an upwardly arched arcuate portion.

In a preferred embodiment the handle further comprises:

a rear connecting member joining the rear end portions of the two oppositely disposed side handle members and having side end portions, wherein the rear connecting member is cooperatively connected to the rear handle.

Preferably the front end portions of the two oppositely disposed side handle members are smoothly interconnected respectively with the side end portions of the front handle member and the rear end portion of the two oppositely disposed side handles are smoothly interconnected respectively with the side end portions of the rear connecting member.

In a preferred embodiment, the handle further comprises:

a front connecting member having two end portions, the two end portions of the front connecting member being respectively secured to the two oppositely disposed side handle members, wherein the front connecting member bears against the main housing.

Preferably the two oppositely disposed side handle members are tilted upwardly with respect to the basal plane from rear to front.

Viewed from a further aspect the present invention provides a handheld power tool for buffing a workpiece comprising:

a main housing having a buffing member in a basal plane, wherein the main housing houses a mechanism operable to drive the buffing member;

a rear handle mounted rearwardly on the main housing; and an annular handle mounted around the main housing, wherein the annular handle adopts a wavy profile. Particularly preferably the annular handle adopts a substantially chair-like configuration relative to the basal plane. More preferably the chair-like configuration of the annular handle is rearward facing.

In a preferred embodiment, the annular handle comprises:

two oppositely disposed side handle members each having a front end and a rear end and at least one upwardly arched arcuate portion and a front handle member connected between the front ends of the two oppositely disposed side handle members.

Preferably the two oppositely disposed side handle members adopt a substantially S-shaped profile.

Preferably the front handle member adopts a substantially inverted U-shaped profile.

Preferably the annular handle further comprises:

a rear connecting member joining the rear end portions of the two oppositely disposed side handle members wherein the rear connecting member cooperates with the rear handle.

Preferably the annular handle further comprises:

a front connecting member having two end portions, the two end portions of the front connecting member being respectively secured to the two oppositely disposed side handle members, wherein the front connecting member is mounted against the main housing. Particularly preferably the front connecting member is respectively secured to the two oppositely disposed side handle members in the plane of the wavy profile. Particularly preferably the front connecting member adopts a substantially U-shaped profile. Particularly preferably the front connecting member has a cutaway portion which permits the front connecting member to be seated against the main housing. More preferably the front connecting member adopts a substantially X-shaped profile.

The rear handle may adopt a rigid substantially C-shaped prifile. For example, the rear handle may have a main body with substantially parallel, dependent arms and may be axially mounted on the main housing at the end of the arms.

The main housing typically houses the components and mechanism which drives the buffing member to buff the workpiece.

DETAILED DESCRIPTION OF THE PREFERRED EMBODIMENT

Referring to FIGS. 1 to 3, 5 and 7, an embodiment of the handheld power tool of the invention includes a main housing 2, a rear handle 8 which is mounted on the main housing 2 and an annular handle 10 which is connected to (and around) the main housing 2. The main housing 2 houses the driving mechanism and has a buffing member 6 in the basal plane. The rear handle 8 has a substantially C-shaped configuration and extends axially from the main housing 2.

Figure 8:
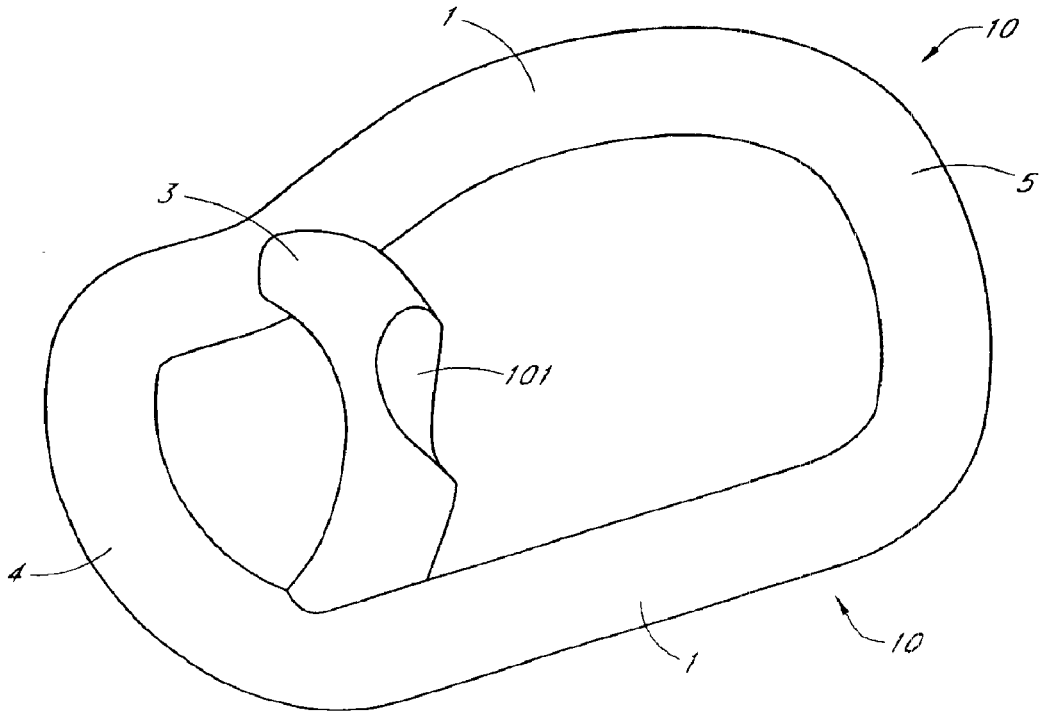
FIG. 8 shows a perspective isolated view of the handle of the embodiment of the present invention.

The annular handle 10 is shown in isolation in FIG. 8 and comprises two oppositely disposed side handle members 1 and a front handle member 4 which joins the front end portions of the two oppositely disposed side handle members 1. The front end portions of the two oppositely disposed side handle members 1 are smoothly interconnected with the side end portions of the front handle member 4. The two oppositely disposed side handle members 1 are tilted gradually upwardly with respect to the basal plane from rear to front. The two oppositely disposed side handle members 1 and the front handle member 4 each have an upwardly arched arcuate portion giving them S-shaped and inverted U-shaped profiles respectively.

A rear connecting member 5 joins the rear end portions of the two oppositely disposed side handle members 1 and is cooperatively connected to the rear handle 8. The rear end portions of the two oppositely disposed side handle members 1 are smoothly interconnected with the side end portions of the rear connecting member 5. As will be apparent from FIG. 8 in particular, the annular handle 10 adopts a substantially chair-like configuration relative to the basal plane which is rearward facing.

The handle 10 further includes a front connecting member 3 with a cut-away portion 101 mounted against the front face of the main housing 2. The two end portions of the front connecting member 3 are respectively fixed to the two oppositely disposed side handle members 1 in the plane of the chair-like configuration.

Figure 1:
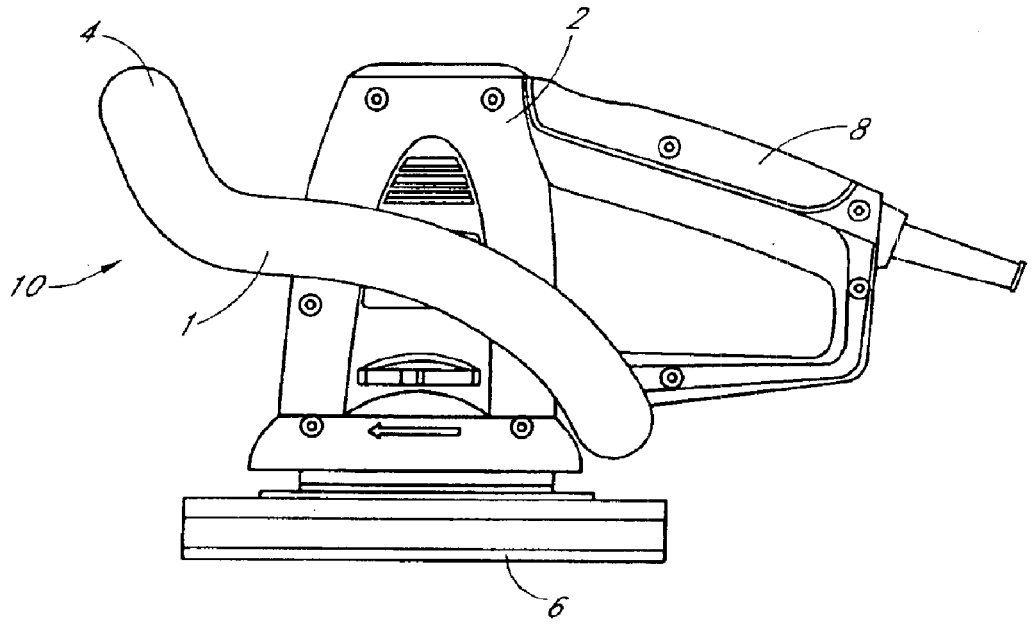
FIG. 1 shows a front view of an embodiment of the present invention.
Figure 2:
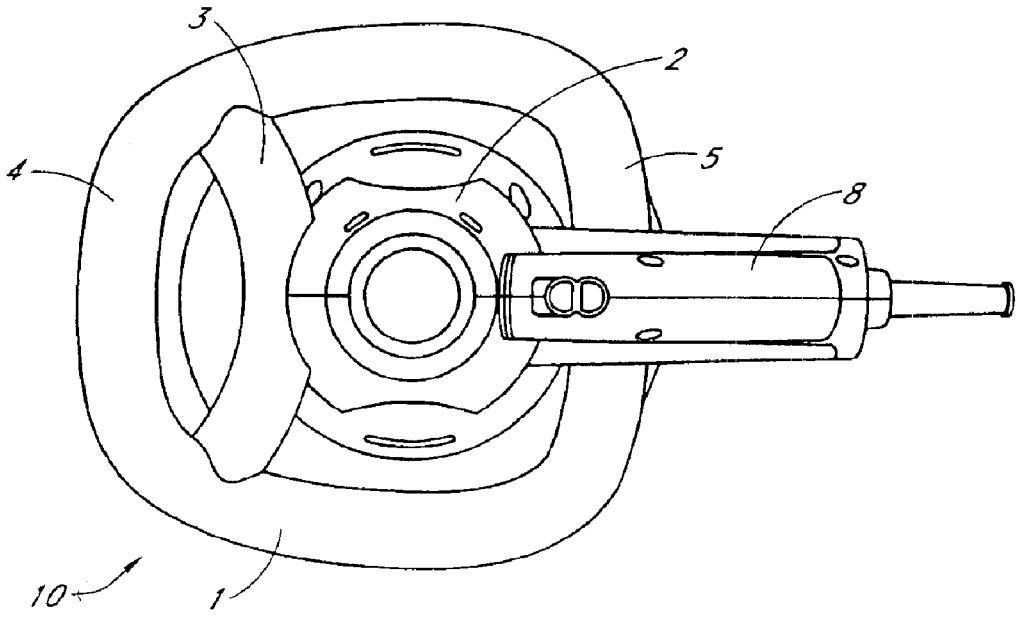
FIG. 2 shows a top view of the embodiment of the present invention.
Figure 3:
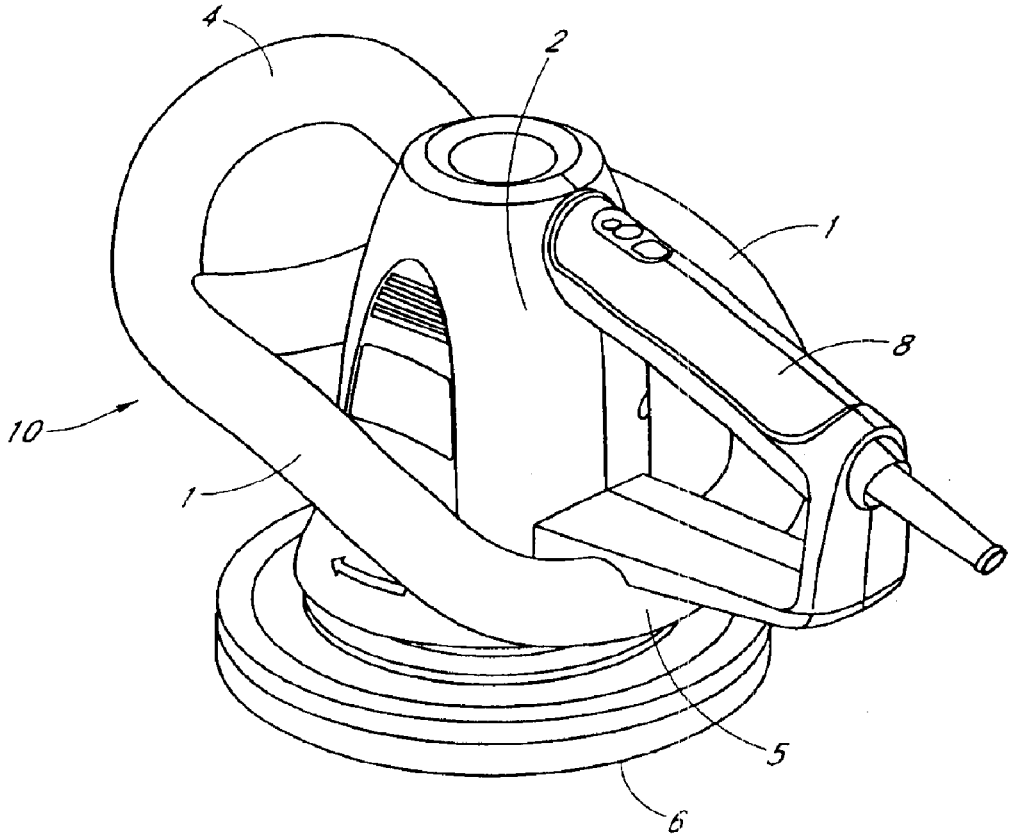
FIG. 3 shows a perspective view of the embodiment of the present invention.
Figure 4:
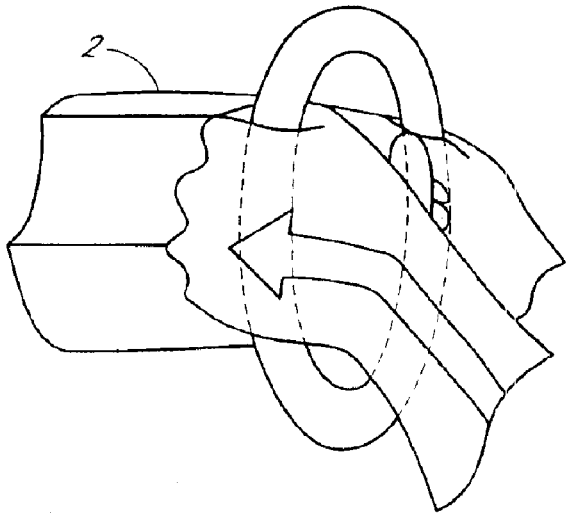
FIG. 4 shows the use of a prior art handheld power tool.
Figure 5:
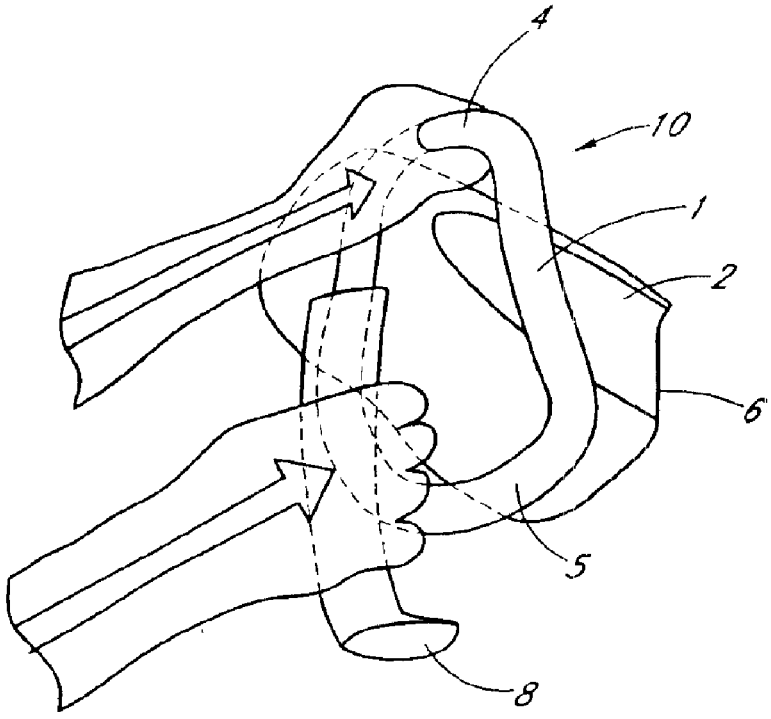
FIG. 5 shows the use of the embodiment of the present invention.
Figure 6:
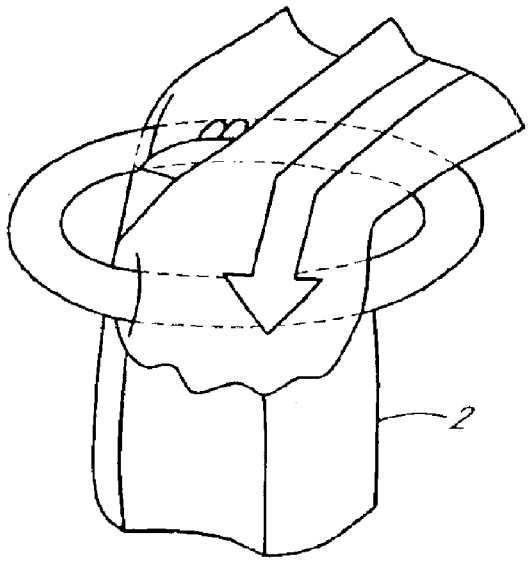
FIG. 6 shows the use of the prior art handheld power tool.
Figure 7:
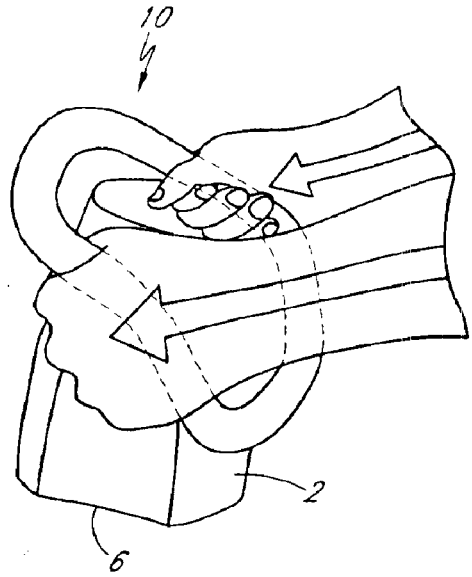
FIG. 7 shows the use of the embodiment of the present invention.

FIGS. 5 and 7 are intended to illustrate the minimal bend which must be deployed in the operators wrists to operate the buffing member 6 in the basal plane of the main housing 2.

What is claimed is:

1. A handheld power tool for buffing a workpiece comprising:

a main housing having a buffing member in a basal plane, wherein the main housing houses a mechanism operable to drive the buffing member;

a rear handle mounted rearwardly on the main housing; and an annular handle mounted around the main housing, wherein the annular handle adopts a wavy profile and wherein the annular handle includes two oppositely disposed side handle members each having a front end and a rear end and at least one upwardly arched arcuate portion, a front handle member connected between the front ends of the two oppositely disposed side handle members and a front connecting member that has a substantially U-shaped profile, wherein the front connecting member has two end portions that are respectively secured to the two oppositely disposed side handle members and wherein the front connecting member is mounted against the main housing.

2. The handheld power tool according to claim 1, wherein the annular handle adopts a substantially chair-like configuration relative to the basal plane.

3. The handheld power tool according to claim 2, wherein the chair-like configuration is rearward facing.

4. The handheld power tool according to claim 1, wherein the two oppositely disposed side handle members adopt a substantially S-shaped profile.

5. The handheld power tool according to claim 1, wherein the front handle member has an upwardly arched arcuate portion.

6. The handheld power tool according to claim 5, wherein the front handle member adopts an inverted substantially U-shaped profile.

7. The handheld power tool according to claim 1, wherein the annular handle further comprises a rear connecting member joining the rear end portions of the two oppositely disposed side handle members wherein the rear connecting member cooperates with the rear handle.

8. The handheld power tool according to claim 1, wherein the two side handle members define a substantially chair-like configuration and wherein the front connecting member is respectively secured to the two oppositely disposed side handle members in the plane of the substantially chair-like configuration.

9. The handheld power tool according to claim 1, wherein the front connecting member has a cutaway portion which permits the front connecting member to be seated against the main housing.

10. The handheld power tool according to claim 1, wherein the front connecting member adopts a substantially X-shaped profile.

* * * * *